US008309211B2

(12) United States Patent
Mehta et al.

(10) Patent No.: US 8,309,211 B2
(45) Date of Patent: Nov. 13, 2012

(54) BREATHABLE NON-ASPHALTIC ROOFING UNDERLAYMENT

(75) Inventors: Vinay Mehta, Bridgewater, NJ (US); Awdhoot Vasant Kerkar, Rockaway, NJ (US)

(73) Assignee: Building Materials Investment Corporation, Wilmington, DE (US)

( * ) Notice: Subject to any disclaimer, the term of this patent is extended or adjusted under 35 U.S.C. 154(b) by 0 days.

(21) Appl. No.: 10/702,689

(22) Filed: Nov. 6, 2003

(65) Prior Publication Data

US 2005/0097857 A1 May 12, 2005

(51) Int. Cl.
*B32B 27/30* (2006.01)

(52) U.S. Cl. ..... 428/220; 428/335; 442/396; 442/398; 442/287; 442/288; 442/290

(58) Field of Classification Search ..... 442/396, 442/398, 287, 288, 290; 428/220, 335
See application file for complete search history.

(56) References Cited

U.S. PATENT DOCUMENTS

| | | | | |
|---|---|---|---|---|
| 3,531,369 | A | 9/1970 | Baumann, et. al. | |
| 4,073,998 | A | 2/1978 | O'Connor | |
| 4,232,620 | A | 11/1980 | Kurz | |
| 4,282,283 | A * | 8/1981 | George et al. | 442/281 |
| 4,301,204 | A | 11/1981 | McCusker et al. | |
| 4,440,816 | A | 4/1984 | Uffner | |
| 4,511,619 | A * | 4/1985 | Kuhnel et al. | 428/215 |
| 4,585,682 | A | 4/1986 | Colaruso et al. | |
| 4,684,568 | A | 8/1987 | Lou | |
| 4,780,362 | A | 10/1988 | Ruehl et al. | |
| 5,164,258 | A | 11/1992 | Shida et al. | |
| 5,230,950 | A | 7/1993 | Kissle | |
| 5,291,712 | A | 3/1994 | Curran | |
| 5,451,619 | A | 9/1995 | Kluttz et al. | |
| 5,687,517 | A | 11/1997 | Wiercinski et al. | |
| 5,691,034 | A | 11/1997 | Krueger et al. | |
| 5,695,868 | A | 12/1997 | McCormack | |
| 5,869,414 | A | 2/1999 | Fischer et al. | |
| 5,883,024 | A | 3/1999 | O'Haver-Smith et al. | |
| 6,071,834 | A | 6/2000 | Martz | |
| 6,191,221 | B1 | 2/2001 | McAmish et al. | |
| 6,239,046 | B1 | 5/2001 | Viega et al. | |
| 6,300,257 | B1 * | 10/2001 | Kirchberger et al. | 442/77 |
| 6,308,482 | B1 | 10/2001 | Strait | |
| 6,350,709 | B1 | 2/2002 | Viega | |

(Continued)

FOREIGN PATENT DOCUMENTS

EP 0104555 * 4/1984

(Continued)

OTHER PUBLICATIONS

Translation of International Publication No. WO 96/37668, "Air Barrier and Use Thereof in Roofs", published Nov. 28, 1996, pp. 1-20.*

*Primary Examiner* — Elizabeth Cole
(74) *Attorney, Agent, or Firm* — Sills Cummis & Gross P.C.

(57) ABSTRACT

A non-asphaltic roofing underlayment that is breathable, water resistant and skid-resistant is disclosed. The non-asphaltic roofing underlayment includes a woven or non-woven substrate in which at least one surface thereof includes a breathable thermoplastic film disposed thereon. The breathable thermoplastic film imparts water-resistant to the substrate as well as maintains the breathability of the substrate.

17 Claims, 1 Drawing Sheet

U.S. PATENT DOCUMENTS

| | | | |
|---|---|---|---|
| 6,458,724 | B1 | 10/2002 | Viega et al. |
| 6,479,154 | B1 | 11/2002 | Walton et al. |
| 6,500,560 | B1 | 12/2002 | Kiik et al. |
| 6,586,353 | B1 | 7/2003 | Kiik et al. |
| 6,645,336 | B1 | 11/2003 | Albertone et al. |
| 6,645,565 | B2 | 11/2003 | Viega |
| 6,645,887 | B2 | 11/2003 | Kocinec et al. |
| 6,677,258 | B2 | 1/2004 | Carroll et al. |
| 6,698,458 | B1 | 3/2004 | Sollars, Jr. et al. |
| 6,701,971 | B1 | 3/2004 | Sollars, Jr. et al. |
| 6,734,123 | B2 | 5/2004 | Veiga et al. |
| 6,740,607 | B2 | 5/2004 | Veiga et al. |
| 6,770,578 | B2 | 8/2004 | Veiga |
| 6,797,356 | B2 | 9/2004 | Zupon et al. |
| 6,864,195 | B2 | 3/2005 | Peng |
| 2002/0081924 | A1 | 6/2002 | Fensel et al. |
| 2003/0040241 | A1 | 2/2003 | Kiik et al. |
| 2003/0194566 | A1 | 10/2003 | Corzani et al. |
| 2004/0091677 | A1 * | 5/2004 | Topolkaraev ..... 428/184 |
| 2004/0092696 | A1 | 5/2004 | Vedula et al. |
| 2004/0106345 | A1 | 6/2004 | Zafiroglu |
| 2005/0124240 | A1 | 6/2005 | Porter |

FOREIGN PATENT DOCUMENTS

| | | | |
|---|---|---|---|
| EP | 657502 | A1 * | 6/1995 |
| EP | 1245620 | A2 * | 10/2002 |
| WO | WO 9637668 | A1 * | 11/1996 |

* cited by examiner

BREATHABLE NON-ASPHALTIC ROOFING UNDERLAYMENT

FIELD OF THE INVENTION

The present invention relates to a building materials composite, and more particularly to a non-asphaltic roofing underlayment that is breathable, water-resistant and skid-resistant.

BACKGROUND OF THE INVENTION

In the roofing industry, a roofing underlayment is typically applied to the deck of a roof prior to application of shingles or other roofing material. The primary goal of the roofing underlayment is to shield the roofing deck from asphalt (from the back surface of shingles) which otherwise would necessitate tearing up the whole deck instead of just the shingles—a costly option—at the time of reroofing. Underlayments can also help to reduce "picture framing" in which the outline of the deck panels caused by irregularities in the deck surface may be visible through the roofing material applied to the roofing deck.

In most cases, the roofing underlayment comprises a felt material composed of cellulose fibers, glass fibers and a mixture thereof that is saturated with a bituminous material such as asphalt, tar or pitch. Roofing underlayments that are saturated with a bituminous material are thick composites (typically 20 to 60 mils thick), which can be hazardous to manufacture due to the presence of a flammable bituminous material. Many of the asphaltic underlayments available in the market tend to wrinkle after being applied to a roofing deck. This is especially the case if the underlayments are rained upon. Other common problems are blowing off due to wind (when shingles are yet to be installed) or the formation of splits lengthwise in the underlayments when they are left exposed for several days.

In addition to bituminous-containing underlayments, the roofing industry has also developed non-bituminous, i.e., non-asphaltic, underlayments. The prior art non-bituminous underlayments typically include TRIFLEX 30 (marketed by Northern Roof Tiles Sales Co. of Ontario, Canada), TITANIUM UDL (marketed by Interwrap, Inc. of Canada), ROOFTOPGUARD II (marketed by Classic Products, Inc and Drexel Metals), KAYE-FLEX UDL (from Kaye Industries, Florida), etc.

Currently, all non-asphaltic underlayments tend to be water-resistant but substantially non-breathable. That is, the non-asphaltic underlayments do not allow air or water vapor to pass through it. As a result, the moisture from the interior of the building is unable to escape to the exterior resulting in damage to the roof over a number of years. Most of the non-asphaltic underlayments also tend to be slippery, especially when wet.

In view of the drawbacks mentioned above with prior art non-asphaltic underlayments, there is a need for providing a non-asphaltic roofing underlayment that is breathable thereby allowing moisture to escape from inside the building, while preventing water and/or moisture from entering the building. In addition, skid-resistance is a highly desirable property of an underlayment to avoid injuries from roofers sliding off of the roof. Also, sealing around nails or other roof penetrations would provide additional protection towards substantially waterproofing the system.

SUMMARY OF THE INVENTION

The present invention provides an improved non-asphaltic underlayment useful in roof assemblies which comprises a substrate (typically non-water-resistant, but can be water-resistant) in which at least one surface thereof includes a breathable thermoplastic film selected from (1) a polyurethane based thermoplastic film, (2) an ethylene-methacrylate (EMA) copolymer or ethylene acrylic acid based thermoplastic film, or (3) a micro-porous polyolefinic or polyester film that may be filled or unfilled. Combinations and/or multilayered stacks of such breathable thermoplastic films are also contemplated herein.

The substrate can comprise a thermoplastic polymer or copolymer or a felt material coated with breathable film at least on one side but preferably both sides.

The term "non-water-resistant" substrate denotes a material that is substantially pervious to water, i.e., a material that permits water permeation from the exterior of the roofing to the interior of the roofing.

The terms "breathability" or "breathable" refers to a material or materials which is permeable to water vapor or moisture having a minimum moisture vapor transmission rate (MTVR) of 3 perms, i.e., about 172.2 nanograms per pascal per second per square meter ($ng/(Pa \cdot s \cdot m^2)$) or greater. The MTVR is measured using a standard ASTM measurement, i.e., ASTM E96-80 Proc. A.

The presence of the breathable film on the substrate makes the resultant composite water-resistant and yet imparts breathability of the substrate. The inventive non-asphaltic underlayment of the present invention acts as a barrier to moisture, but allows air and water vapor to pass therethrough. In addition to providing water-resistance to the substrate, the presence of one of the aforementioned breathable thermoplastic films on a top surface of the substrate also imparts improved skid resistance, i.e., high coefficient of resistance, to the non-asphaltic underlayment. Such an underlayment having a skid-resistant surface will also provide improved adhesion of asphaltic peel and stick (P&S) adhesive products (like Liberty™ of GAFMC) to the underlayment where the latter is used as a base sheet.

The term "non-asphaltic underlayment" is used in the present invention to describe a roofing composite containing no asphalt that is laid down on a roofing deck prior to shingle application.

The present invention also provides a method of manufacturing the non-asphaltic underlayment of the present invention. In broad terms, the method of the present invention comprises applying at least one of the above mentioned breathable thermoplastic films to at least one surface layer of a woven or non-woven, organic or inorganic substrate.

The present invention also provides a roofing system that comprises the inventive non-asphaltic, breathable underlayment and one or more shingles laid-up on the uppermost layer of the underlayment.

DETAILED DESCRIPTION OF THE INVENTION

Figure 1:
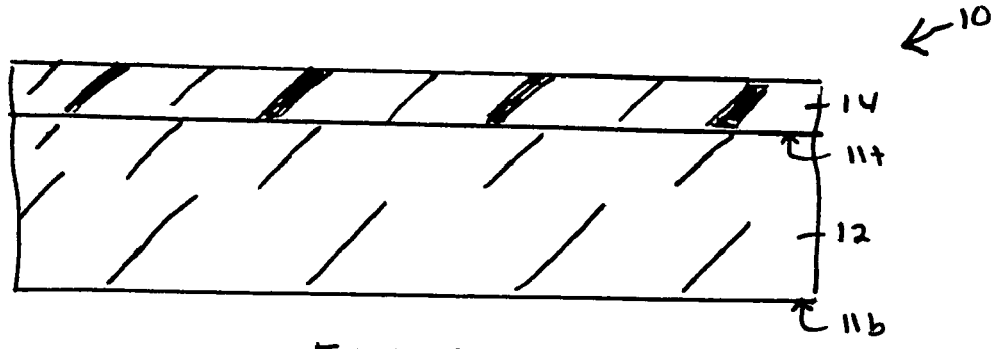
FIG. 1 is a pictorial representation (through a cross-sectional view) illustrating a non-asphaltic underlayment of the present invention.

The present invention, which provides a non-asphaltic underlayment that is breathable, water-resistant and skid resistant, will now be described in greater detail by referring to the following description and drawings that accompany the present application. In the accompanying drawings, like and/or corresponding elements are referred to by like reference numerals.

Figure 2:
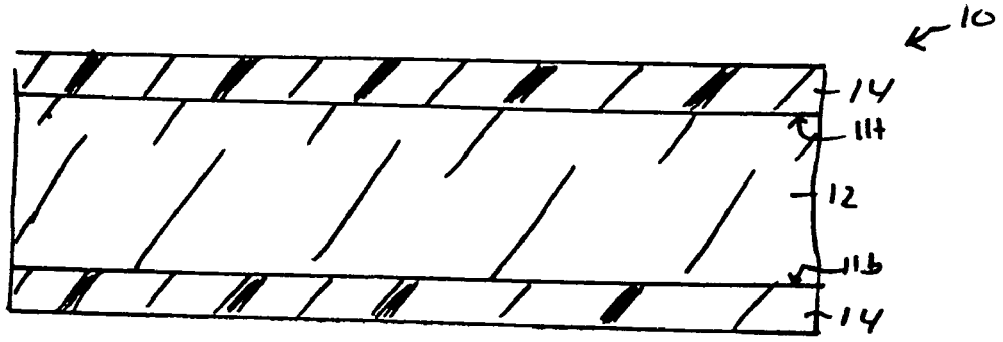
FIG. 2 is a pictorial representation (through a cross-sectional view) illustrating another non-asphaltic underlayment of the present invention.
Figure 3:
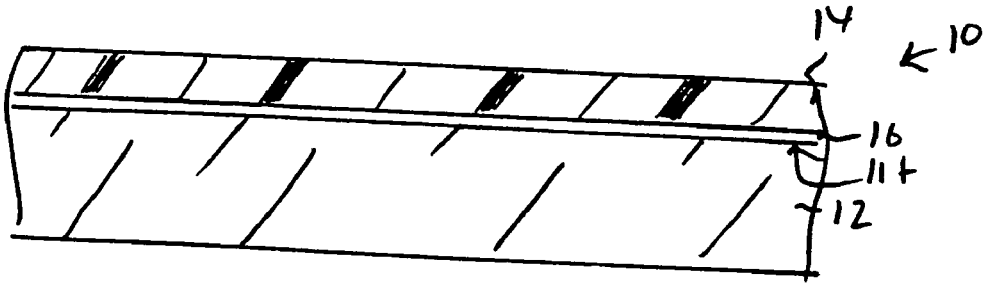
FIG. 3 is a pictorial representation (through a cross-sectional view) illustrating yet another non-asphaltic underlayment of the present invention.

FIGS. 1, 2 and 3 of the present application illustrate various embodiments of the present invention. Specifically, FIGS. 1, 2 and 3 are cross-sectional views showing the non-asphaltic underlayment 10 of the present invention.

In FIG. 1, there is illustrated a two-piece non-asphaltic underlayment 10 that comprises a substrate 12 having a breathable thermoplastic film (BTF) 14 applied to a top surface lt of the substrate 12. The substrate 12 is typically substantially non-water-resistant. In this embodiment, the top surface including the breathable thermoplastic film 14 will face in a direction opposite of the roofing deck such that one or more shingles are laid-up directly on the breathable thermoplastic film 14 of the underlayment 10. Although FIG. 1 shows the breathable thermoplastic film 14 on an upper surface of the substrate 12, it is also contemplated in the present invention to have an underlayment in which the breathable thermoplastic film 14 is present on a bottom surface 11*b* of the substrate 12.

FIG. 2 shows a preferred embodiment of the present invention in which the substrate 12 is sandwiched between two-breathable thermoplastic films 14. That is, the top surface 11*t* and bottom surface 11*b* of the substrate 12 both include a breathable thermoplastic film 14 thereon. FIG. 2 thus represents a three-piece underlayment.

In FIG. 3, there is shown an embodiment in which a tie layer 16 is present between the substrate 12 and the breathable thermoplastic film 14. The presence of the tie layer 16 improves the adhesion of the breathable thermoplastic film 14 to the substrate 12. The tie layer 16, which may also be referred to as a compatibilizer or a bonding agent, may be used in any embodiment of the present invention.

The substrate 12 employed in the present invention comprises an organic or inorganic reinforcement sheet or film that is capable of withstanding high ambient temperatures. The substrate is typically, but not always, non-water-resistant. The reinforcement sheet or film can comprise a thermoplastic polymer or copolymer or a felt material. The substrate may be woven or non-woven, with preference given to a non-woven substrate. No asphalt or other like bituminous material is present in or on the substrate 12. The substantially non-water-resistant woven or non-woven substrate of the present invention is sometimes referred to in the art as a scrim.

Illustrative examples of reinforcement thermoplastic polymeric materials that can be employed in the present invention as the substrate 12 include, but are not limited to: polyolefins, such as, for example, polyethylene (high density, linear low density, low density or medium density) and polypropylene; polyethylene terephthalate (PET); polyamides; polyvinyl chlorides (PVC's); polystyrenes; polyacrylics; and any copolymers thereof.

For purposes of definition herein, the term "high density polyethylene" denotes a polyethylene composition having a density of about 0.941 g/cc or higher; the term "medium density polyethylene" denotes a polyethylene composition having a density of about 0.926 to about 0.940 g/cc; and the terms "low density or linear low density polyethylene" denote a polyethylene composition having a density of about 0.90 to about 0.925 g/cc.

Of the various thermoplastic polymeric materials mentioned above, it is preferred to use a thermoplastic reinforcement material that comprises polyethylene, polypropylene or PET. The thermoplastic reinforcement material used as the substrate 12 is made using techniques well-known in the art including, for example, polymerization of at least one monomer in the presence of a suitable polymerization catalyst such as a metallocene or Ziegler/Natta catalyst; extrusion molding and cutting.

The substrate 12 may also be a felt material such as a cellulose fiber mat or a glass fiber mat. These types of substrates are made using techniques well known to those practicing the art.

The substrate 12 may have any thickness associated therewith, but typically the thickness of the substrate 12 is from about 6 to about 60 mils. The substrate 12 is breathable and is usually, but not always, non-water-resistant.

In one embodiment, the breathable thermoplastic film 14 is a polyurethane based thermoplastic film (or thermoplastic polyurethane (TPU)). The polyurethane based thermoplastic film is a polymeric material obtained by first forming a prepolymer of polyether or polyester diols or polyols with excess diisocyanate and then chain-extending the prepolymer by reacting with a diamine or a diol. Copolymers including the TPU are also contemplated as the breathable thermoplastic film 14.

Suitable TPU's that can be employed as the breathable thermoplastic film 14 are available from Noveon (Esthane®), Merquinsa NA Inc. (Pearlthane®/Pearlcoat®), Dow Chemical Company (Pellethane®), BASF (Elastollan®), Bayer (TEXIN/DESMOPAN®) or Huntsman (AVALON® or IROGRAN®).

In another embodiment of the present invention, the breathable thermoplastic film 14 is an ethylene methacrylate (EMA) copolymer (such as ELVALOY from DuPont), a polyolefin-based EMAC (such as SP2220 from Eastman Chemical Co.), or an ethylene acrylic acid based copolymer. These copolymer films offer similar properties as the TPU, i.e., breathable and yet water-resistant.

In yet another embodiment of the present invention, the breathable thermoplastic film 14 is a micro-porous polyolefinic (polyethylene, polypropylene and other like polyolefins including copolymers thereof) or a polyester polymer, which may or may not contain a filler therein.

In the case of polyolefinic or polyester based materials having filler induced micro-pores, those materials are made breathable upon stretching the film under appropriate conditions well known to those versed in the art. In one embodiment, polypropylene with $CaCO_3$ fillers having micro-pores coated onto a glass mat is envisaged as a roofing underlayment that is breathable and yet water-resistant.

In order to improve the adhesion between filled or unfilled extrusion coated polyolefins such as polyethylene (PE) or polypropylene (PP) and glass mat—necessary for enhanced abrasion resistance—the following specific options are envisaged:

(1) Maleic anhydride grafted PP (blended up to 10%, but more preferably up to 5%) to regular PP batch. MAgPP is commercially available from DuPont (as FUSABOND), Atofina (as LOTADAR or OREVAC) and other vendors.

(2) Titanate or Zirconate coupling agents such as those available from Kenrich Petrochemicals, Inc. for improving the PP (preferably with fillers such as carbon black) bond to glass fibers. Ken-React's CAPS NZ 12/L (zirconate based) or CAPS L 38/L (titanate based) at 5% CAPS by weight of PP or lower, but more preferably 1 to 3% by weight can be used. Slight lowering of extrusion temperatures (typically about 10%), to create high shear for reactive compounding and dispersion of the titanate or zirconate masterbatch in the PP melt so that fiberglass mat can be subsequently coated uniformly.

(3) In addition to (1) and (2) above, additional silane treatment to glass may become necessary as intimate mixing of glass fibers with PP (as in an extruder) cannot be done in composite process described herein. The well-known silane agents are aminoalkyltrialkoxysilanes such as 1-dimethylamino-2-propanol or 2-dimethylamino-2-methyl-1-propanol or 3-aminopropyl triethoxysilane in the presence of a salifying agent (KOH) and an emulsifier such as polyoxyethylene octylphenyl ether.

Skid-resistance of polyolefinic coated underlayments can be increased by incorporating ethyl-vinyl acetate (EVA) or modified EVA such as malefic anhydride grafted EVA (like FUSABOND C series sold by DuPont) up to 10% (most preferably 1-3%) by weight of PP.

In yet another embodiment of the present invention, the breathable thermoplastic film 14 is a multilayered stack that includes any combination of above-mentioned breathable thermoplastic materials.

The thickness of the breathable thermoplastic film 14 may vary, but typically it is from about 0.5 to about 10 mils, with a thickness from about 1 to about 3 mils being more highly preferred. Thicker breathable thermoplastic films 14 are also contemplated.

In embodiments in which a tie layer 16 is present, the tie layer 16 comprises a bonding agent, such as, for example, a polyamide, an ethylene copolymer such as ethylene vinyl acetate (EVA), ethylene ethyl acrylate (EEA), ethylene acrylic acid (EAA), ethylene methyl acrylate (EMA) (such as SP2207, SP2403, or SP1307 grades from Voridian) and ethylene normal-butyl acrylate (ENBA). However, the most-preferred material as a tie layer 16 is EMA having a methyl acrylate level of about 18% or greater.

The tie layer may be applied during formation of the substrate by including the bonding agent within the polymerization process, during the formation of the breathable thermoplastic film, or after substrate formation using one of the methods described below.

The substrate 12 may be coated in a variety of ways. For example, the breathable thermoplastic film 14 may be applied to the substrate 12 by die-extrusion coating, air spraying, dip coating, knife coating, roll coating or a film application such as lamination/heat pressing. The breathable thermoplastic film 14 may also be bonded to the substrate 12 by chemical bonding, mechanical bonding and/or thermal bonding. Mechanical bonding may be achieved by force-feeding the breathable thermoplastic film 14 onto the substrate 12 with a knife. Each of the above mentioned methods are well-known to those skilled in the art; therefore a detailed description concerning the specifics of the methods are not needed herein.

The underlayment made in accordance with the present invention may be of any shape or size. Preferably, the underlayment of the present invention is substantially planar in shape. The substrate may be coated on one or both sides depending on the intended application.

The underlayment of the present invention can also be coated or sprayed with an algaecide such as, for example, zinc powder, or copper oxide powder; a herbicide; an antifungal material such as MICRO-CHEK 11P; an antibacterial material such as MICRO-CHEK 11-S-160; a surface fiction agent such as BYK-375, a flame retardant material such as ATH (aluminum trihydrate) available from, e.g., Akzo Chemicals and antimony oxide available from, e.g., Laurel Industries and/or a coloring dye such as T-1133A and iron oxide red pigments, and other products which can impart specific surface functions. The MICRO-CHEK products are available from the Ferro Corporation of Walton Hills, Ohio. BYK-375 may be obtained from Wacker Silicone Corporation of Adrian, Mich. and T-1133A is sold by Abco Enterprises Inc. of Allegan, Mich. The additional coatings of, e.g., water repellent material, antifungal material, antibacterial material, etc., may be applied to one or both sides of underlayment of the present invention.

The water-resistant and breathable underlayment 10 of the present invention is used as a component of a roofing system together with one or more conventional shingles. In this application, the underlayment of the present invention is first applied to the roofing deck and then secured thereto using securing means well-known to those skilled in the art, such as by nail or staple application. Next, one or more shingles are laid-up on the uppermost layer of the underlayment 10 and thereafter the shingle is secured to the roofing deck. The lay up and securing steps are well-known to those skilled in the art. Types of shingles that can be used in the present invention include, but are not limited to: asphalt-containing single or multi-ply shingles.

In some embodiments, the underlayment of the present invention forms an effective seal around any penetrations that are introduced to the roofing product.

While the present invention has been particularly described and illustrated with respect to preferred embodiments thereof, it will be understood by those skilled in the art that the foregoing and other changes in forms and details may be made without departing from the spirit and scope of the present invention. It is therefore intended that the present invention is not limited to the exact forms and details described and illustrated, but fall within the scope of the appended claims.

What we claim as new is:

1. A non-asphaltic underlayment comprising:

a glass fiber-based substrate in which a first surface thereof is directly adhered to a breathable thermoplastic film having a minimum thickness of 2 mils, the breathable thermoplastic film comprises a thermoplastic polyurethane blended with ethylene methacrylate polymer, wherein the ethylene methacrylate polymer acts as an adhesion improvement component that improves adhesion between the breathable thermoplastic film and the glass fiber-based substrate, said breathable thermoplastic film imparts water-resistance to the underlayment while maintaining breathability thereof, the breathable thermoplastic film having a minimum moisture vapor transmission rate of greater than about 3 perms.

2. The non-asphaltic underlayment of claim 1 further comprising a skid-resistance component blended into the breathable thermoplastic film, the skid-resistance component comprising at least 1-10% of ethyl-vinyl acetate or maleic anhydride grafted ethyl-vinyl acetate.

3. The non-asphaltic underlayment of claim 1 further comprising a second breathable thermoplastic film located on a second surface of the glass fiber-based substrate.

4. The non-asphaltic underlayment of claim 1 wherein the substrate is woven or non-woven.

5. The non-asphaltic underlayment of claim 4 wherein the substrate is a non-woven glass-fiber based substrate.

6. The non-asphaltic underlayment of claim 1 wherein the substrate has a thickness from about 5 to about 60 mils.

7. The non-asphaltic underlayment of claim 1 wherein the breathable thermoplastic film has a thickness of about 2 to about 10 mils.

8. The non-asphaltic underlayment of claim 1 further comprising at least one of a water repellent material, an algaecide, an herbicide, an antifungal material, a surface friction agent, a flame retardant, or a coloring dye.

9. The non-asphaltic underlayment of claim 1 wherein the underlayment is a base sheet of a peel and stick roofing product.

10. A non-asphaltic underlayment comprising a substantially non-water-resistant polypropylene substrate in which at least a top surface thereof is directly adhered to a polyurethane based thermoplastic film, said polyurethane based thermoplastic film imparts water-resistance to the underlayment while maintaining breathability of the underlayment, the breathable thermoplastic film having a minimum moisture vapor transmission rate of 3 perms or greater the polyurethane based thermoplastic film being blended with about 40 to 60% ethylene methacrylate polymer to improve adhesion between the polyurethane based thermoplastic film and the substantially non-water-resistant polypropylene substrate.

11. The non-asphaltic underlayment of claim 2 wherein the skid-resistance component is a surface friction agent.

12. A non-asphaltic underlayment comprising:

a breathable thermoplastic film comprising a thermoplastic polyurethane blended with ethylene methacrylate polymer, the ethylene methacrylate polymer acting as an adhesion improvement component; and a substrate, the substrate having a thickness of about 6 to 60 mils, the substrate being air sprayed with more than two mils but less than 10 mils of the breathable thermoplastic film, wherein the breathable thermoplastic film imparts water-resistance to the underlayment while maintaining breathability thereof as defined in ASTM E96 standard.

13. The non-asphaltic underlayment of claim 12 further comprising a skid-resistance component blended into the breathable thermoplastic film, the skid-resistance component comprising at least 1-10% of ethyl-vinyl acetate or malefic anhydride grafted ethyl-vinyl acetate.

14. The non-asphaltic underlayment of claim 12 further comprising a second breathable thermoplastic film air sprayed onto a second surface of the substrate.

15. The non-asphaltic underlayment of claim 12 wherein the substrate is nonwoven polypropylene.

16. The non-asphaltic underlayment of claim 12 further comprising a water repellent material, an algaecide, an herbicide, an antifungal material, a surface friction agent, a flame retardant, a coloring dye and combinations thereof.

17. The non-asphaltic underlayment of claim 12 wherein the underlayment is a base sheet of a peel and stick roofing product.

* * * * *